US006562539B1

(12) United States Patent
Chatow et al.

(10) Patent No.: US 6,562,539 B1
(45) Date of Patent: May 13, 2003

(54) PRINTERS AND COPIERS WITH PRE-TRANSFER SUBSTRATE HEATING

(75) Inventors: Ehud Chatow, Raanana (IL); Naseem Yacoub, Rehovot (IL); Peter Forgacs, Jerusalem (IL)

(73) Assignee: Indigo N.V., Maastricht (NL)

( * ) Notice: Subject to any disclaimer, the term of this patent is extended or adjusted under 35 U.S.C. 154(b) by 0 days.

(21) Appl. No.: 09/914,521

(22) PCT Filed: Jul. 5, 1999

(86) PCT No.: PCT/IL99/00363

§ 371 (c)(1),
(2), (4) Date: Aug. 27, 2001

(87) PCT Pub. No.: WO01/02910

PCT Pub. Date: Jan. 11, 2001

(51) Int. Cl.[7] ..... G03G 9/08; G03C 3/00

(52) U.S. Cl. ..... 430/117; 430/126; 430/252; 399/297; 399/307

(58) Field of Search ..... 430/117, 126, 430/252; 399/297, 307

(56) References Cited

U.S. PATENT DOCUMENTS

| | | | | |
|---|---|---|---|---|
| 3,893,761 | A | | 7/1975 | Buchan et al. |
| 4,207,102 | A | * | 6/1980 | Dessauer ..... 250/318 |
| 4,286,039 | A | | 8/1981 | Landa et al. |
| 4,439,035 | A | | 3/1984 | Landa |
| 4,794,651 | A | | 12/1988 | Landa et al. |
| 4,980,259 | A | | 12/1990 | Landa et al. |
| 5,028,964 | A | | 7/1991 | Landa et al. |
| 5,047,306 | A | | 9/1991 | Almog |
| 5,089,856 | A | | 2/1992 | Landa et al. |
| 5,117,263 | A | | 5/1992 | Adam et al. |
| 5,148,222 | A | | 9/1992 | Lior et al. |
| 5,166,734 | A | | 11/1992 | Pinhas et al. |
| 5,225,306 | A | | 7/1993 | Almog et al. |
| 5,231,454 | A | | 7/1993 | Landa |
| 5,255,058 | A | | 10/1993 | Pinhas et al. |
| 5,264,313 | A | | 11/1993 | Landa et al. |
| 5,266,435 | A | | 11/1993 | Almog |
| 5,276,492 | A | | 1/1994 | Landa et al. |
| 5,289,238 | A | | 2/1994 | Lior et al. |
| 5,300,390 | A | | 4/1994 | Landa et al. |
| 5,346,796 | A | | 9/1994 | Almog |
| 5,376,491 | A | | 12/1994 | Krumberg et al. |
| 5,410,392 | A | | 4/1995 | Landa |

(List continued on next page.)

FOREIGN PATENT DOCUMENTS

| | | |
|---|---|---|
| EP | 0 672 967 | 9/1995 |
| WO | WO 92/17823 | 10/1992 |
| WO | WO 94/22059 | 9/1994 |
| WO | WO 95/04307 | 2/1995 |
| WO | WO 96/01442 | 1/1996 |
| WO | WO 96/07955 | 3/1996 |
| WO | WO 96/13760 | 5/1996 |
| WO | WO 96/26469 | 8/1996 |
| WO | WO 96/29633 | 9/1996 |
| WO | WO 96/31809 | 10/1996 |
| WO | WO 97/07433 | 2/1997 |
| WO | WO 98/55901 | 12/1998 |
| WO | WO 99/61958 | 12/1999 |
| WO | WO 00/31593 | 6/2000 |

*Primary Examiner*—Mark A. Chapman
(74) *Attorney, Agent, or Firm*—Fenster & Company

(57) ABSTRACT

A method of transferring an image on a surface to a substrate comprising: a) heating the surface to a first temperature above a temperature at which the image adheres to the substrate; b) heating the substrate to a second temperature above ambient temperature and below the first temperature; c) pressing the substrate to the surface; d) cooling the image while it is in contact with both the surface and the substrate such that it cools during said contact to a third temperature, below a temperature at which its cohesion is greater than its adhesion to the surface; and e) then separating the substrate from the surface, said image being transferred to the substrate.

42 Claims, 6 Drawing Sheets

U.S. PATENT DOCUMENTS 5,436,706 A 7/1995 Landa et al.
5,555,185 A 9/1996 Landa
5,572,274 A 11/1996 Lior et al.
5,592,269 A 1/1997 Younes et al.
5,610,694 A 3/1997 Lior et al.
5,629,761 A 5/1997 Theodoulou et al.
5,737,666 A 4/1998 Lior et al.
5,745,829 A 4/1998 Gazit et al.
5,800,954 A * 9/1998 Kato et al. ..... 399/302
5,854,960 A 12/1998 Tagansky et al.
5,908,729 A 6/1999 Landa et al.

* cited by examiner

PRINTERS AND COPIERS WITH PRE-TRANSFER SUBSTRATE HEATING

RELATED APPLICATIONS

The present application is a U.S. national application of PCT/IL99/00363, filed Jul. 5, 1999.

FIELD OF THE INVENTION

The present invention relates to printers and copiers and in particular to printers and copiers that utilize heated intermediate transfer members.

BACKGROUND OF THE INVENTION

Printers and copiers are well known. Modern copiers utilize powder or liquid toners comprising toner particles to form visible images. Generally, a latent electrostatic image is formed on an image forming surface (such as a photoreceptor). The image is developed using a toner (such as the aforementioned powder or liquid toners), and the developed image is transferred to a final substrate (i.e., paper). Often, the transfer is indirect; an intermediate transfer member (ITM) receives the image from the image forming surface and transfers it to a final substrate, usually by heat and pressure.

The need of heat and pressure in combination, for fixing and fusing the image onto the substrate arises from the particular properties of the toner particles, the carrier liquid and the substrate. In some liquid toners in which the toner particles solvate and are swelled by the carrier liquid. Good image transfer occurs when the following conditions are met:

1. just prior to transfer, the image is above the solvation temperature (generally, about 65–95° C.), to produce swelling and softening of the toner particles and preferably to bring about coalescing of the toner particles;
2. as it is pressed against the paper, the image must be warm enough to penetrate the paper fibers and to bind to them (or to bind to a plastic or coated plastic substrate); and
3. while pressed against the paper, the image must cool sufficiently so that its adhesion to the ITM is less that the cohesion of the toner particles amongst themselves. Under this condition, and assuming that adhesion to paper is greater than that to the ITM, the image is transferred in its entirety to the paper with no cracking of the image and with no appreciable residue on the ITM.

In other words, a good image transfer is obtained when a suitable temperature versus time profile of the image is maintained.

This process was first described in U.S. Pat. No. 5,555,185, the disclosure of which is incorporated herein by reference.

In some systems, the substrate is in web form. In others, it is in sheet form.

In general, the systems described in the aforementioned patent and in other patents utilizing the same system rely on heating the ITM so that prior to transfer, the image temperature is higher than the solvation temperature. Generally, the ITM comprises a structure which allows the image to cool sufficiently during transfer. However, to assure good transfer, the image temperature must be 25–30° C. higher than the solvation temperature (depending on the ink concentration) so that the image does not cool below the solvation temperature too quickly (i.e., before it binds to the substrate). Generally, the ITM comprises a blanket. When the external blanket temperature is at about 90–110° C., the back of the blanket and the external surface of the ITM drum are much hotter, often by as much as 60–70° C.

These relatively high operating temperatures place severe requirements on the materials used for the ITM blanket and reduces their operating life. Reducing the operating temperatures will improve life and increase the range of materials that may be used.

In U.S. Pat. Nos. 5,410,392 and 5,592,269, the disclosures of which are incorporated by reference, the opposite approach is taken. In these patents the paper is heated to a temperature above the solvation temperature prior to transfer. During the transfer the toner is heated by the paper and is fixed to the paper by beat and pressure. The paper cools by contact with the ITM during the transfer process.

SUMMARY OF THE INVENTION

One aspect of some preferred embodiments of the present invention relates to providing an imaging apparatus with a heated ITM and a pre-transfer heated substrate. By preheating the substrate to a temperature below the solvation temperature, the operating temperatures of the ITM and blanket can be reduced, when compared to those in the prior art, while maintaining a desired temperature versus time profile of the image during the transfer process. Furthermore, the good transfer properties achievable with a heated ITM are not only retained, but in many cases, transfer is actually improved.

In some preferred embodiments of the invention, the substrate is in web form, and pre-transfer heating takes place just upstream of the point of image transfer.

In some preferred embodiments of the invention, the substrate is heated by direct contact with a hot roller, pressed against it, upstream of the point of image transfer.

Alternatively, the substrate is heated by a radiant heater, positioned slightly over or under it, upstream of the point of image transfer.

Alternatively, the substrate is heated by a microwave radiator, positioned slightly over or under it, upstream of the point of image transfer.

Alternatively, the substrate is heated by a hot air blower, positioned slightly over or under it, upstream of the point of image transfer.

Alternatively, the substrate is heated by other heater as known in the art.

Each of the aforementioned methods of pre-heating of the substrate has certain advantages and certain disadvantages in terms of heating efficiency, safety, control features, simplicity of the design, freedom from malfunctions and uniformity of heating.

In some preferred embodiments of the invention, the substrate is in sheet form, and pre-transfer heating takes place when the sheet is on the backing roller, ahead of the point of transfer. Preferably, the substrate is heated by a hot air blower. Alternatively, the substrate is heated by a radiant heater. Alternatively, the substrate is heated by a microwave radiator. Alternatively, the substrate is heated by some other heater as known in the art.

Preferably, the substrate is cooled by a blower or other means after transfer of the image to it.

It should be understood that the reduction of temperature of the blanket may have other advantages, in addition to the increase in ITM life. It can also result in improved transfer from the intermediate transfer member to the ITM and/or savings in heater energy. For those systems in which the various separations are collected on the ITM and are transferred together to the final substrate, the lower temperature results in lower evaporation of carrier liquid from the separations on the ITM. Since the separations spend different amounts of time on the ITM, the separations have more nearly the same proportions of toner and carrier liquid when they are transferred to the final substrate. This apparently results in improved fixing on the substrate.

There is thus provided, in accordance with a preferred embodiment of the invention, a method of transferring an image on a surface to a substrate comprising:

(a) heating the surface to a first temperature above a temperature at which the image adheres to the substrate;

(b) heating the substrate to a second temperature above ambient temperature and below the first temperature;

(c) pressing the substrate to the surface;

(d) cooling the image while it is in contact with both the surface and the substrate such that it cools during said contact to a third temperature, below a temperature at which its cohesion is greater than its adhesion to the surface; and (e) then separating the substrate from the surface, said image being transferred to the substrate.

Preferably, the third temperature is between the first and second temperatures.

Preferably, the second temperature is below the temperature at which the image cohesion is greater than its adhesion to the surface.

In a preferred embodiment of the invention, the image is cooled in (d) by transfer of heat from the image to the substrate, preferably substantially only by transfer of heat from the image to the surface.

Preferably the substrate is heated during said cooling of the image such that its temperature is greater than the second temperature.

In a preferred embodiment of the invention, the substrate is heated during said cooling of the image substantially only by heat transfer from the surface and from the image. Preferably the method includes cooling the substrate and the image thereon, after (e) to a temperature at least as low as the second temperature.

In a preferred embodiment of the invention, the temperature variation of the image while the surface is pressed against the image is such that the image remains at a temperature that is high enough for a time long enough to assure adhesion of the image to the substrate during separation of the surface from the substrate.

Preferably, the adhesion of the image after said cooling thereof to the substrate is greater than is its adhesion to the surface.

Preferably, the image is formed on an image forming member and transferred to said surface prior to subsequent transfer therefrom to the substrate, such that the surface is the surface of an intermediate transfer member. Preferably, the image forming member is a photoreceptor.

In a preferred embodiment of the invention, the image is formed by an electrostatic process.

Preferably, the image is formed by an electrophotographic process in which a latent electrostatic image is developed by a toner to form said image.

Preferably, the image is a toner image, preferably a liquid toner image. Preferably, the liquid toner image on the surface comprises toner particles and carrier liquid. Preferably, the carrier liquid at elevated temperatures above a solvation temperature and wherein the first temperature is above the solvation temperature. Preferably, the second temperature is below the solvation temperature. Preferably, the third temperature is below the solvation temperature.

In a preferred embodiment of the invention, the substrate is formed of paper. Alternatively, the substrate is formed of a plastic.

There is further provided, in accordance with a preferred embodiment of the invention, imaging apparatus comprising:

a heated image bearing surface having a toner image thereon;

an impression surface which is urged toward the image bearing surface to form an image transfer region therebetween;

a substrate transport mechanism which transports a substrate through the image transfer region at which said image is transferred to said substrate;

a heater that heats the substrate upstream of the image transfer region, such that it is at room temperature as it enters the image transfer region between pre-transfer heated substrate onto which the developed image is transferred.

In a preferred embodiment of the invention a desired temperature versus time profile of the developed image is maintained by controlling both the temperature of the intermediate transfer member and of the substrate.

Preferably, the apparatus utilizes the method of the invention.

BRIEF DESCRIPTION OF THE DRAWINGS

The present invention will be more clearly understood from the following detailed description of the preferred embodiments of the invention and from the attached drawings, in which same number designations are maintained throughout the figures for each element and in which.

DETAILED DESCRIPTION OF PREFERRED EMBODIMENTS

Figure 1:
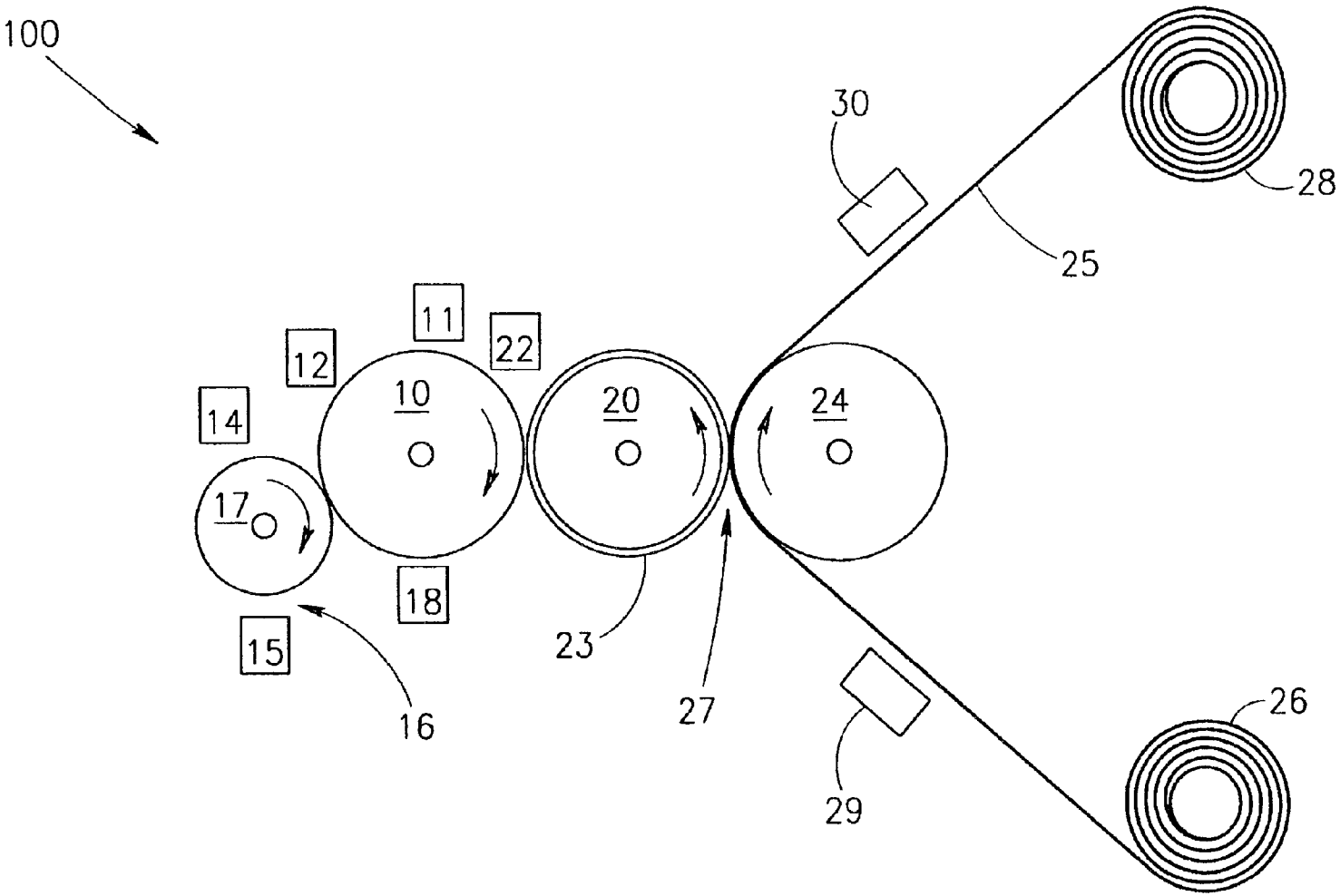
FIG. 1 is a schematic block diagram of imaging apparatus with a heated ITM and a pre-transfer heated substrate, in accordance with a preferred embodiment of the present invention.

Reference is now made to FIG. 1 which is a schematic block diagram of imaging apparatus 100 with a heated intermediate transfer member (ITM) 20 and a pre-transfer heated substrate 25, in accordance with a preferred embodiment of the present invention. In preferred embodiments of the invention, the ITM may be the same as or similar to the ITMs and ITM systems described in one or more of U.S. Pat. Nos. 5,089,856; 5,572,274; 5,410,392; 5,592,269; 5,745,829; PCT published PCT applications WO 97/07433; WO 98/55901; WO 96/13760; and unpublished PCT applications PCT/IL/98/00576; and PCT/IL98/00553 or it may be another suitable ITM as known in the art.

Preferably, imaging apparatus 100 is an electrostatic copier or printer and comprises an image bearing surface, typically embodied in a rotating photoconductive drum 10, for example an organic photoreceptor or of selenium. Preferred photoreceptors, are, for example, those described in U.S. Pat. No. 5,376,491 or in PCT published application WO 96/07955. Associated with photoconductive drum 10 is photoconductor charging apparatus 11, such as a corotron or scorotron as known in the art. For example, charging apparatus as described in published PCT application WO 94/22059 or unpublished PCT application PCT/IL98/00553 may be used. Also associated with photoconductive drum 10 is an imager 12, for example, a laser scanner, for providing a desired latent image on drum 10 by selectively discharging the drum. The latent image normally includes image areas at a first electrical potential and background areas at another electrical potential.

Preferably, electrostatic, imaging apparatus 100 also comprises a multicolor liquid developer assembly 16 which preferably includes a developer roller electrode 17, spaced from photoconductive drum 10 and typically rotating in the same sense as drum 10. This rotation provides for the surfaces of drum 10 and roller 17 to have opposite velocities at their region of propinquity. Preferably, developer assembly 16 also includes a multicolor, liquid-toner supply assembly 14, for providing colored liquid toner to develop latent images on photoconductive drum 10, and a used liquid-toner collection assembly 15. Preferred developer systems of the type described above, useful in the present invention are described, for example in U.S. Pat. Nos. 5,028,964; 5,231,454; 5,289,238; 5,148,222; 5,255,058; 5,117,263 or published PCT application WO 96/29633, the disclosures of all of which are incorporated by reference. Preferably, toner of the general type described in U.S. Pat. No. 4,794,651 is desirable for use in the present invention. Moreover, U.S. Pat. Nos. 4,980,259; 5,555,185; 5,047,306; 5,572,274; 5,410,392; 5,436,706; 5,225,306; 5,266,435; 5,610,694; 5,346,796; 5,737,666; 5,745,829; 5,908,729; 5,300,390; 5,264,313; and PCT published applications WO 92/17823; WO 95/04307; WO 96/01442; WO 96/01442; WO 96/13760; WO 96/26469; WO 96/31809, the disclosures of all of which are incorporated by reference, describe preferred toners and charge directors for use in the present invention. Alternative development systems, suitable for the present invention include those described in U.S. Pat. Nos. 5,436,706; 5,610,694; 5,737,666 and in PCT published application WO 96/31809, the disclosures of all of which are incorporated by reference. Alternatively other toner and development systems, known in the art may be used.

Preferably, electrostatic, imaging apparatus 100 also comprises a cleaning station 22 and a pre-transfer image conditioning assembly 18 which may include pre-transfer excess liquid removal and photoreceptor discharge mechanism. Preferred cleaning station, useful in the practice of the present invention are described in U.S. Pat. No. 4,439,035 and unpublished PCT application PCT/IL98/00553, the disclosure of which is incorporated herein by reference. Pre-transfer excess liquid removal and discharge mechanisms useful in the present invention are described, for example, in U.S. Pat. Nos. 4,286,039; 5,276,492; 5,572,274; 5,166,734; 5,854,960.

Preferably, image transfer is indirect: the image is transferred from drum 10 to substrate 25 via an ITM 20, comprising a blanket 23.

Preferably, substrate 25 is a paper or plastic web 25, backed by an impression roller (backing roller) 24. Substrate 25 is fed from a feeding roll 26 and is collected on a take-up roll 28.

Preferably, after developing an image in a given color, the developed single-color image is transferred from drum 10 to ITM 20. Subsequent images in different colors are sequentially transferred in alignment onto ITM 20. When all the desired images have been transferred thereto, the complete multicolor image is transferred from ITM 20 to substrate 25 by heat and pressure. Preferably, backing roller 24 is operatively disengaged from ITM 20 during the first transfer and development stage. Operative engagement between ITM 20 and backing roller 24 with substrate 25 occurs only when transfer of the composite image to substrate 25 takes place.

Alternatively, but less preferably, each single-color image is transferred to the paper after its formation. In this case, the single color images are transferred seriatim to the paper. This situation is less desirable when using a web, since the motion of and stretching of the web can cause problems in exact superposition of the four colors.

The above described system is well known in the art. In a preferred embodiment of the invention the above system is the Omnius™ Printing Press, marketed by Indigo, N.V. Such systems are described in U.S. Pat. No. 5,908,729, the disclosure of which is incorporated herein by reference.

Preferably, ITM 20 is heated, preferably to a drum surface temperature of about 140° C. The blanket external surface temperature is heated to a temperature of 80° C. (rather than 150–180° C. for the drum surface temperature and 90–110° C., usually about 95° C., for the blanket surface temperature of the prior art), but still, the blanket external surface temperature is higher than the solvation temperature of 60–90° C. Preferably, a radiant heater inside the drum is used to heat the drum. Alternatively, ITM 20 is heated by another method, as known in the art or as described in the previously incorporated references. Depending on the solvation temperature and the temperature of the substrate, other temperatures and even temperatures as much as 10–15° C. lower than those for unheated substrates may be used.

Figure 2A:
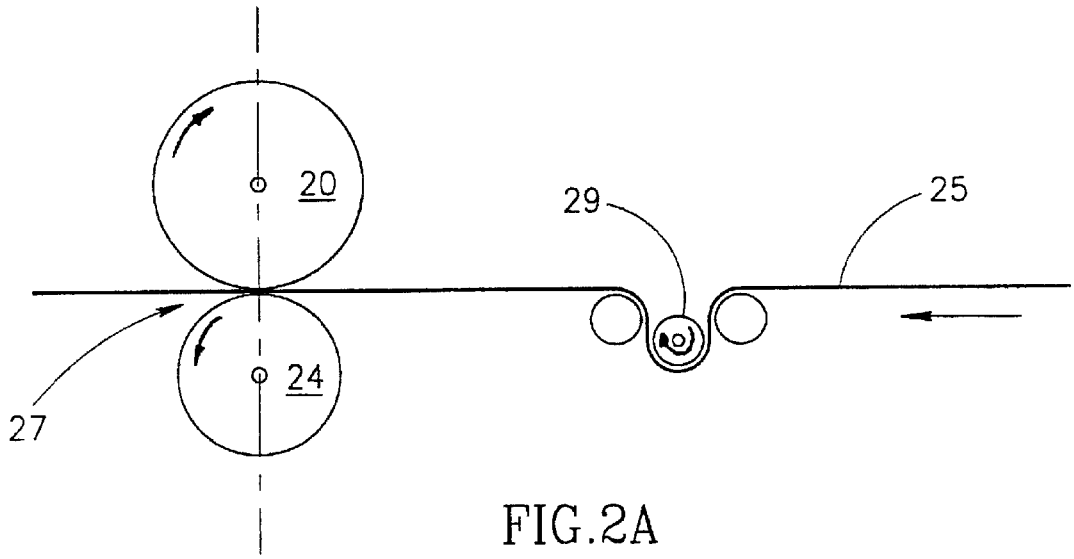
FIGS. 2A–2D are schematic illustrations of pre-transfer substrate heaters, in accordance with preferred embodiments of the present invention.
Figure 2B:
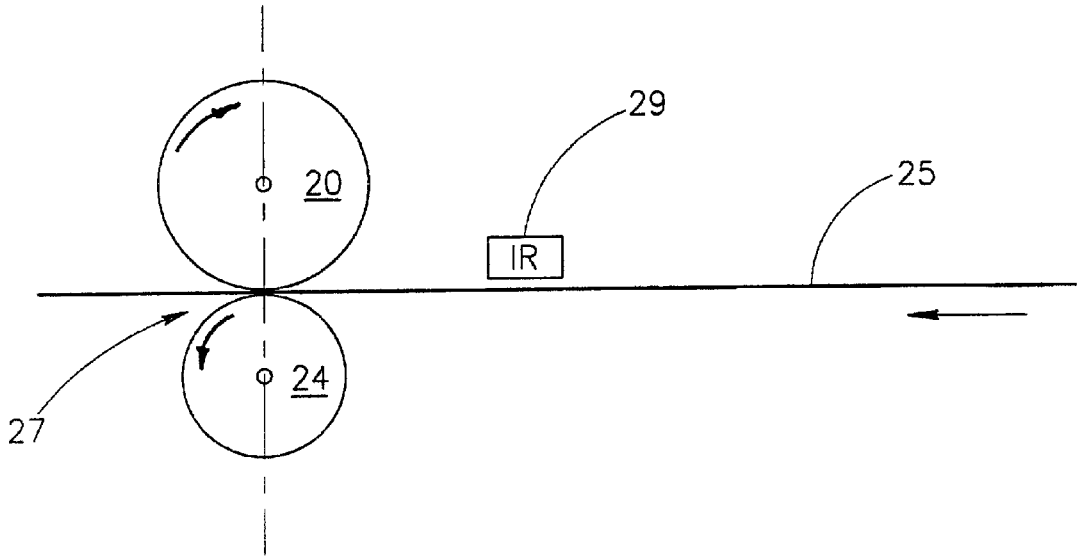
Figure 2C:
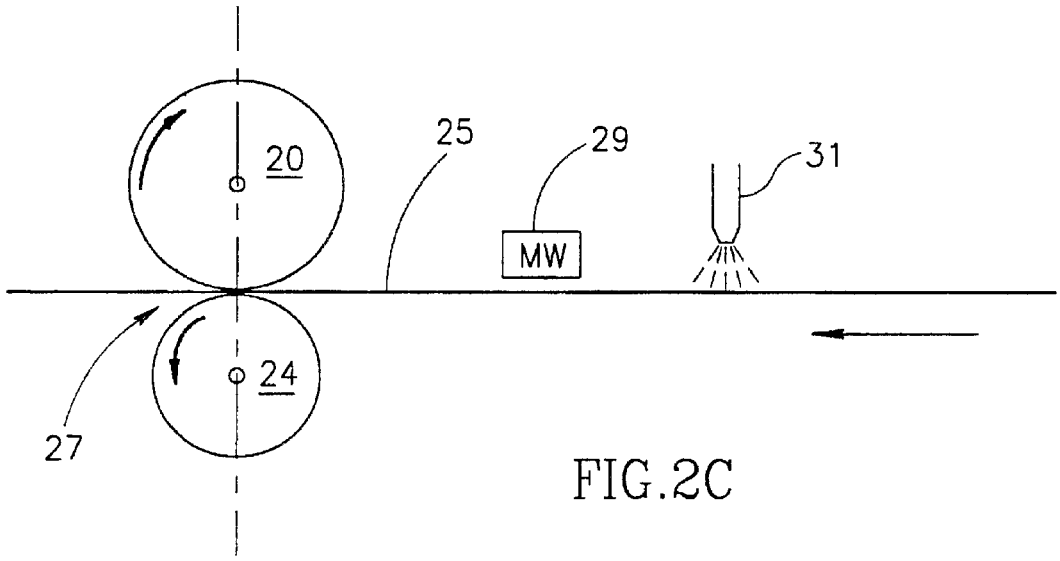
Figure 2D:
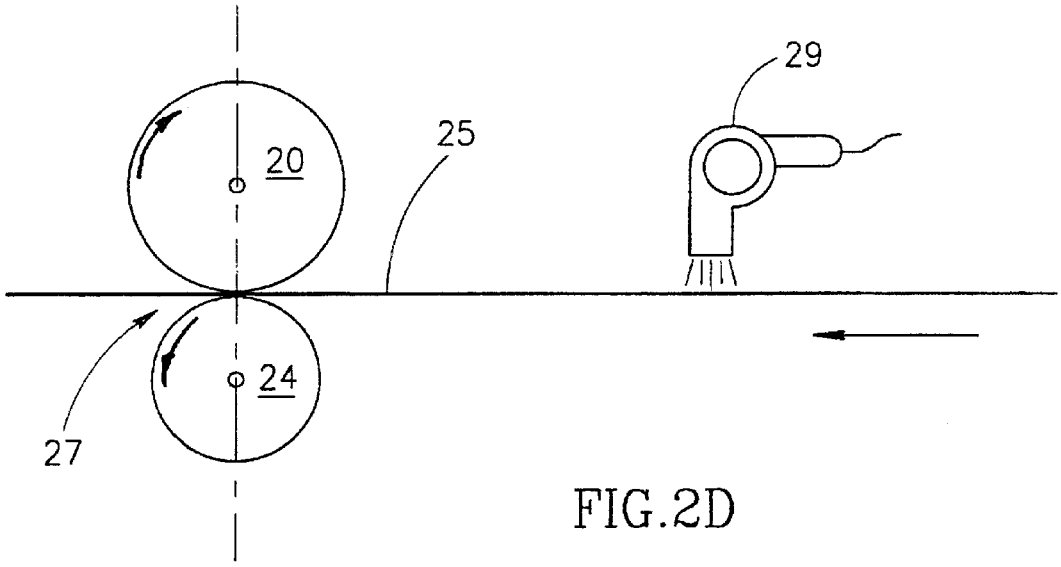

Preferably, an external heater 29 is operatively associated with web 25, upstream of point of image transfer 27. In some preferred embodiments of the present invention as shown in FIG. 2A, heater 29 is a hot roller, in direct contact with, and pressed against web 25. Alternatively as shown in FIG. 2B, heater 29 is a radiant heater positioned slightly over web 25. Alternatively as shown in FIG. 2C, heater 29 is a microwave heater, positioned just over web 25. Alternatively, as shown in FIG. 2D, heater 29 is a hot air blower, positioned over web 25. Alternatively, any other suitable heater as known in the art may be used. In some preferred embodiments heater 29 is positioned under web 25, upstream of point of image transfer 27.

In some preferred embodiments of the invention a fan 30 (or another cooler, such as a contact cooler) may be positioned downstream of the web, to aid in cooling the web, preferably to near room temperature.

Reference is now made to FIGS. 2A–2D, describing the aforementioned methods of pre-heating of the substrate. Each method may have certain characteristics in terms of heating efficiency, safety, control features, simplicity of the design, and freedom from malfunctions, as follows:

1. Hot roll with variable contact area. (FIG. 2A). Heater is in direct contact with the substrate (FIG. 2A). The system has the following features:
   a. high efficiency;
   b. On/Off control by disengaging roller from substrate, heating can be stopped; and
   c. temperature of the substrate is controlled by controlling the temperature of the roller.

2. Infrared heater (FIG. 2B) has the following features:
   a. no direct contact with substrate;
   b. mechanically simple;
   c. safety hazards from possible ignition;
   d. relative lack of On/Off control between frames; and
   e. need of a large radiant surface.
3. Microwave heater (FIG. 2C) has the following features:
   a. no direct contact with substrate;
   b. flexibility and instant control;
   c. efficiency of about 50%;
   d. uniformity of heating; and
   e. a thin coating of MW absorbent material (like water) may be required. In FIG. 2C water is sprayed on the substrate from a water-spray 31. This water is evaporated by the microwave heat.
4. A fan type heater (FIG. 2D) has the following features:
   a. no direct contact with substrate;
   b. mechanically simple;
   c. low efficiency (about 20%); and
   d. low safety hazard.

Figure 3:
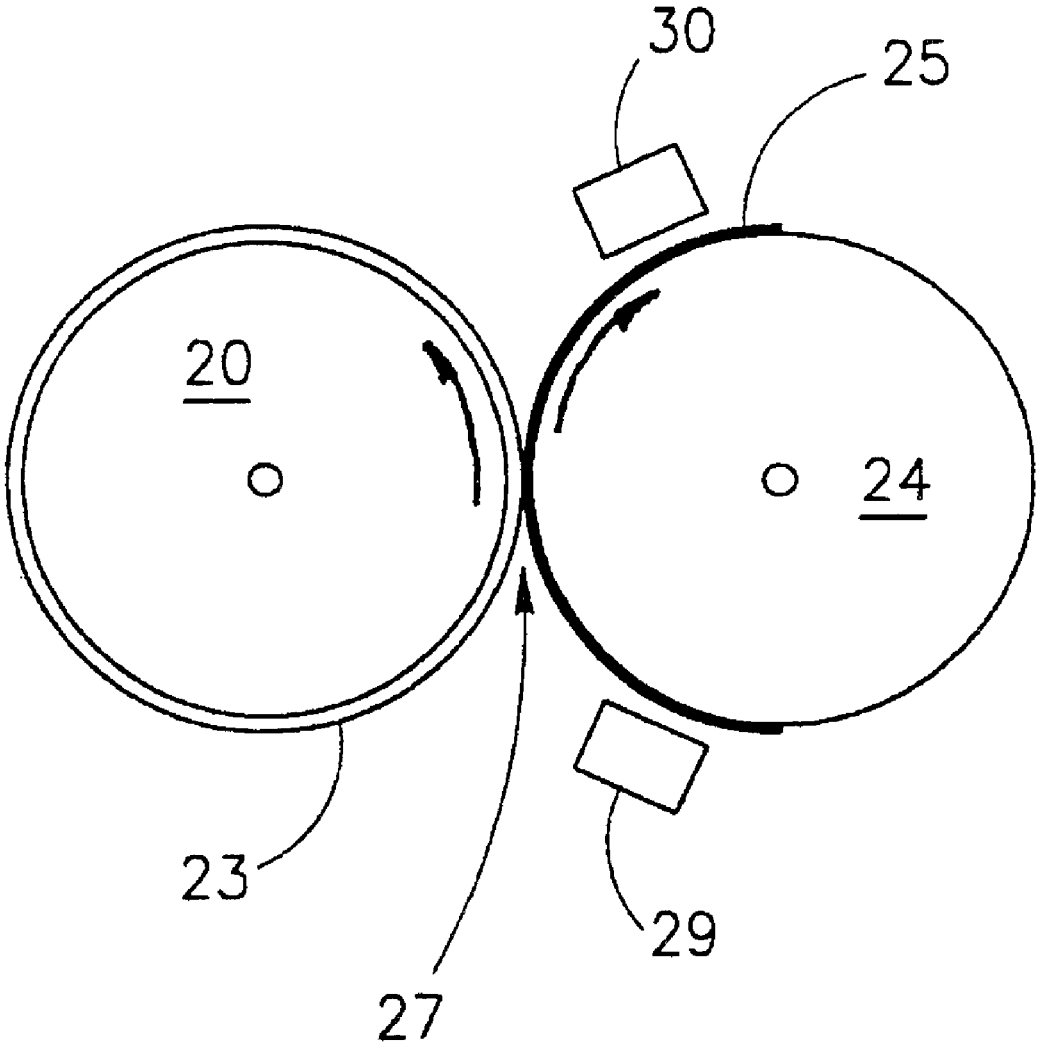
FIG. 3 is a schematic illustration of a pre-transfer substrate heating system wherein the substrate is in sheet form and mounted on an impression roller.

Reference is now made to FIG. 3 which illustrates pre-transfer heating of a substrate in a sheet form, in accordance to another preferred embodiment of the present invention. Preferably, substrate 25, in sheet form, is mounted on an impression roller 24'. Preferably, heater 29, such as a hot air blower, a radiant heater, or any of the aforementioned heaters, or any heater as known in the art, is situated near backing roller 24, pre-heating sheet 25 before it reaches point of image transfer 27. In some preferred embodiments, fan 30, or another cooler, is situated near backing roller 24 to cool sheet 25 after image transfer. For this system, the transfer of color separation images may be separate or together. Other than the addition of elements 29 and 30 and the reduced temperature of the ITM, this system can be essentially the same as that in the E-Print 1000™ Printing Press, marketed by Indigo, N.V.

Figure 4A:
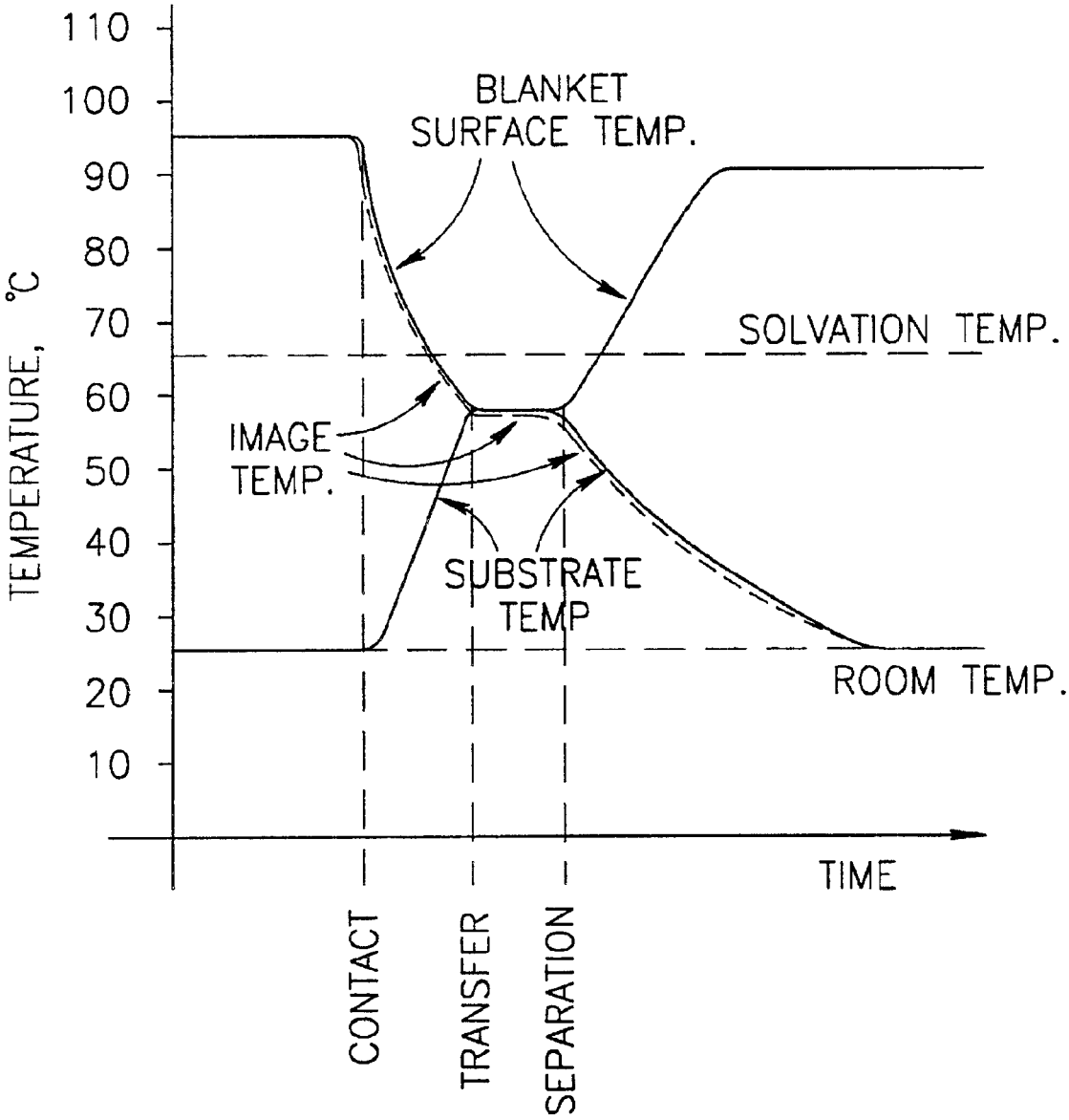
FIG.4A PRIOR ART
FIG. 4A is a schematic diagram of temperature versus time profile of the image, experienced by prior-art systems.
Figure 4B:
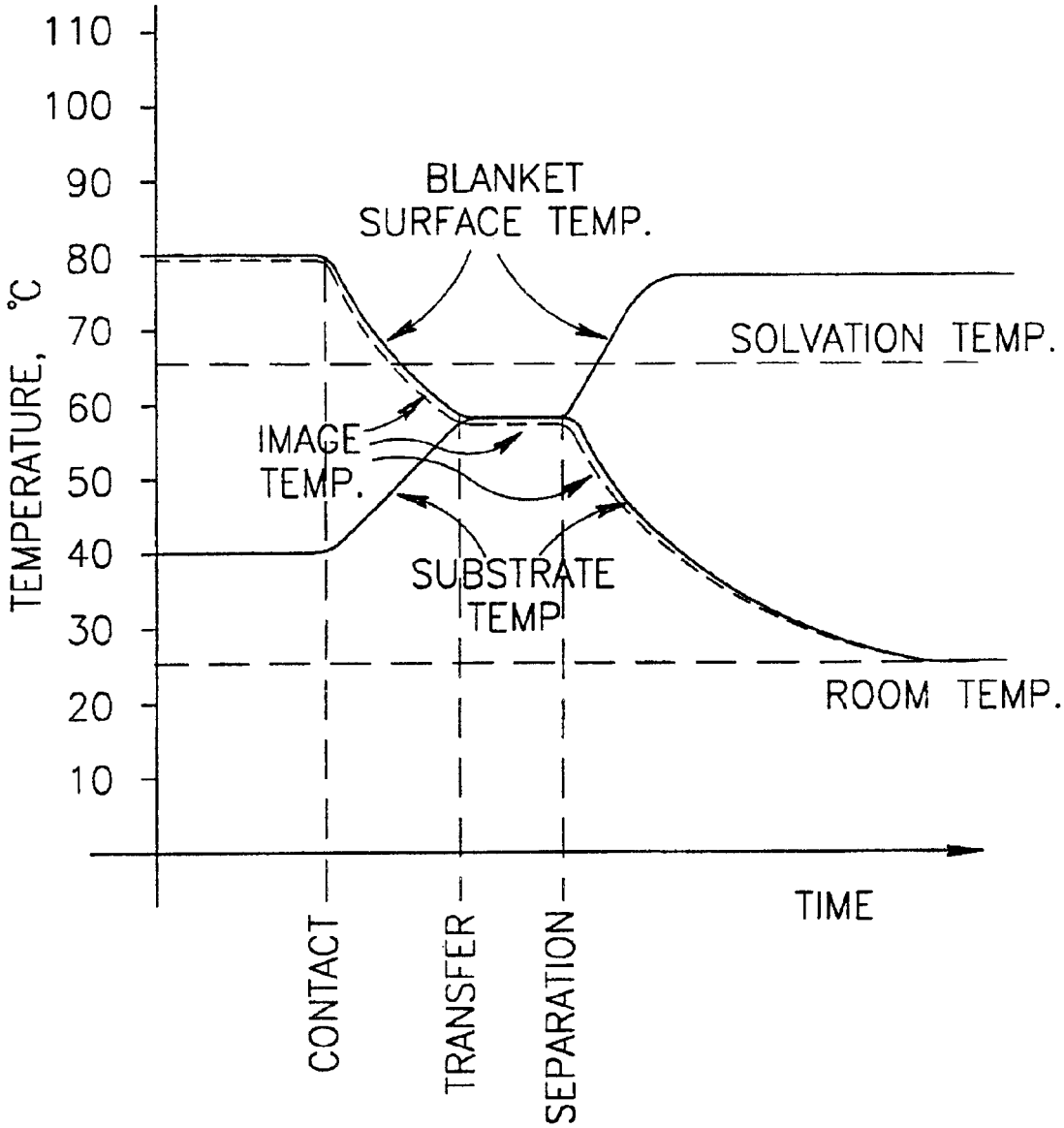
FIG. 4B is a schematic diagram of temperature versus time profile of the image, in accordance with a preferred embodiment of the present invention.

Reference is now made to FIGS. 4A and 4B which are schematic diagrams of temperature versus time profiles of the image, as experienced by prior art systems and in accordance with a preferred embodiment of the present invention.

In FIG. 4A, illustrating an example of a situation experienced by the prior art systems, an image at 95° C. (on an ITM of the same temperature) comes in contact with web 25 at room temperature (about 25° C.). Assuming, for simplicity, equal thermal masses for the ITM and blanket as for the web and backing roller, equilibrium temperature is reached at about 57° C., substantially below the solvation temperature. The image transfer takes place at the equilibrium temperature. Upon separation, web 25 and image cool down to room temperature. The image temperature profile coincides with the blanket surface temperature profile until the point of transfer, and with the substrate temperature profile, after the point of transfer.

In FIG. 4B, an example of time/temperature curves in accordance with a preferred embodiment of the present invention, an image at 80° C. comes in contact with web 25, at an elevated temperature of 45° C. Here too, equilibrium temperature is reached at about 57° C., substantially below the solvation temperature, and the image transfer takes place at the equilibrium temperature. As before, upon separation, web 25 and image cool down to room temperature. Again, the image temperature profile coincides with the blanket surface temperature profile until the point of transfer, and with the substrate temperature profile, after the point of transfer.

Consequently, by pre-heating the substrate to a temperature below the solvation temperature, the operating temperatures of the ITM and blanket can be reduced, when compared to those in the prior art, while maintaining a desired temperature versus time profile of the image during the transfer process.

Note that the temperatures given in FIGS. 4A and 4B are examples, the solvation temperature and other temperatures of the process depend on the particular toner, the actual thermal masses involved, and other factors.

In this example, the operating temperature of the blanket was reduced from 95 to 80° C. by elevating the substrate operating temperature from 25 to 45° C. Generally, the benefit of reducing the higher temperature outweighs the disadvantage of raising the lower temperature.

It should be noted that although the present invention has been described with reference to electrostatic imaging apparatus, and reference has been made to certain prior art patents for information regarding the best mode for carrying out the invention, such reference is a mere example. Imaging apparatus 100 may be any printer or copier, and may be non-electrostatic. The method of forming the image is not important to the present invention; the image may be formed by other ways, as known in the art.

Furthermore, although the present invention has been described with reference to liquid toners, such reference, too, is an example of a best mode. In a preferred embodiment of the invention, imaging apparatus 100 may utilize powder toners, with the temperature of the toner the ITM being high enough to assure that the toner particles attach themselves to the substrate. While the present invention can be applied to liquid or powder toner systems, it is believed to be especially effective for liquid toners, due to the solvation property of the toner/carrier-liquid combinations and to the generally lower temperatures used with solvatable liquid toners. While for powder toners the temperatures are high even when the invention is used, the effect of the small change in blanket temperature for solvatable toners can have a dramatic effect on blanket life, materials availability, print quality and energy requirements.

Similarly, although the present invention has been described with reference to imaging apparatus utilizing ITM, the use of ITM, while desirable, is not absolutely necessary, so long as the image can be heated on the image forming surface. For example, the image is produced by methods other than electrophoresis or on a non-photoreceptor, drum 10, rather than ITM 20 may be heated, and image transfer may be direct, still without affecting the present invention.

The present invention has been described using non-limiting detailed descriptions of preferred embodiments thereof that are provided by way of example and are not intended to limit the scope of the invention. Variations of embodiments described will occur to persons of the art. In particular, while a specific liquid toner imaging apparatus utilizing specific elements has been used for illustrative purposes, the imaging apparatus, including the structure of a printing engine or engines used therein may be of any suitable kind. The terms "comprise, "include," or "have" or their conjugates, shall mean, when used in the claims, "including but not necessarily limited to."

The scope of the invention is limited only by the following claims:

1. A method of transferring an image on a surface to a substrate comprising:

(a) heating the surface to a first temperature above a temperature at which the image adheres to the substrate;

(b) pre-heating the substrate to a second temperature above ambient temperature and below the first temperature;

(c) pressing the pre-heated substrate to the surface;

(d) cooling the image while it is in contact with both the surface and the substrate such that it cools during said contact to a third temperature, below a temperature at which its cohesion is greater than its adhesion to the surface; and (e) then separating the substrate from the surface, said image being transferred to the substrate.

2. A method according to claim 1 wherein the third temperature is between the first and second temperatures.

3. A method according to claim 2 wherein said second temperature is below said temperature at which the image cohesion is greater than its adhesion to the surface.

4. A method according to claim 1 wherein the image is cooled in (d) by transfer of heat from the image to the substrate.

5. A method according to claim 4 wherein the image is cooled in (d) substantially only by transfer of heat from the image to the surface.

6. A method according to claim 1 wherein the substrate is heated during said cooling of the image such that its temperature is greater than the second temperature.

7. A method according to claim 6 wherein the substrate is heated during said cooling of the image substantially only by heat transfer from the surface and from the image.

8. A method according to claim 7 and including cooling the substrate and the image thereon, after (e) to a temperature at least as low as said second temperature.

9. A method according to claim 1 wherein the temperature variation of the image while the surface is pressed against the image is such that the image remains at a temperature that is high enough for a time long enough to assure adhesion of the image to the substrate during separation of the surface from the substrate.

10. A method according to claim 1 wherein the adhesion of the image after said cooling thereof to the substrate is greater than is its adhesion to the surface.

11. A method according to claim 1 wherein the image is formed on an image forming member and transferred to said surface prior to subsequent transfer therefrom to the substrate, such that the surface is the surface of an intermediate transfer member.

12. A method according to claim 11 wherein the image forming member is a photoreceptor.

13. A method according to claim 1 wherein the image is formed by an electrostatic process.

14. A method according to claim 1 wherein the image is formed by an electrophotographic process in which a latent electrostatic image is developed by a toner to form said image.

15. A method according to claim 1 wherein the substrate is formed of paper.

16. A method according to claim 1 wherein the substrate is formed of a plastic.

17. A method according to claim 1 wherein the image is a toner image.

18. A method according to claim 17 wherein the toner image is a image formed by a liquid toner process.

19. A method according to claim 18 wherein the toner image on the surface comprises toner particles and carrier liquid.

20. A method according to claim 19 wherein the toner particles solvate the carrier liquid at elevated temperatures above a solvation temperature and wherein the first temperature is above the solvation temperature.

21. A method according to claim 20 wherein the second temperature is below the solvation temperature.

22. A method according to claim 20 wherein the third temperature is below the solvation temperature.

23. Imaging apparatus comprising:

a heated image bearing surface having a toner image thereon;

an impression surface which is urged toward the image bearing surface to form an image transfer region therebetween;

a substrate transport mechanism which transports a substrate through the image transfer region at which said image is transferred to said substrate;

a heater that heats the substrate upstream of the image transfer region, such that it is at a temperature above room temperature as it enters the image transfer region between pre-transfer heated substrate onto which the developed image is transferred.

24. Imaging apparatus according to claim 23 wherein a desired temperature versus time profile of the developed image is maintained by controlling both the temperature of the intermediate transfer member and of the substrate.

25. Imaging apparatus according to claim 23 wherein:

(a) the surface is heated to a first temperature above a temperature at which the image adheres to the substrate;

(b) the substrate is heated by the heater to a second temperature above ambient temperature and below the first temperature;

(c) the impression surface is operative to press the substrate to the surface at the image transfer region, for a time sufficient such that the image is cooled while it is in contact with both the surface and the substrate to a third temperature, below a temperature at which its cohesion is greater than its adhesion to the surface.

26. Imaging apparatus according to claim 25 and including:

means for separating the substrate from the surface, after said pressing, such that said image is transferred to the substrate.

27. Apparatus according to claim 26 wherein the third temperature is between the first and second temperatures.

28. Apparatus according to claim 25 wherein said second temperature is below said temperature at which the image cohesion is greater than its adhesion to the surface.

29. Apparatus according to claim 25 wherein the image is cooled substantially only by transfer of heat from the image to the surface.

30. Apparatus according to claim 25 wherein the substrate is heated during said cooling of the image such that its temperature is greater than the second temperature.

31. Apparatus according to claim 30 wherein the substrate is heated during said cooling of the image substantially only by heat transfer from the surface and from the image.

32. Apparatus according to claim 25 and comprising:

an image forming member on which the image is formed, wherein said image transferred to said surface prior to subsequent transfer therefrom to the substrate, such that the surface is the surface of an intermediate transfer member.

33. Apparatus according to claim 32 wherein the image forming member is a photoreceptor.

34. Apparatus according to claim 33 and including:

means for forming a latent electrostatic image on said image forming member; and means for developing latent electrostatic image by a toner to form said image.

35. Apparatus according to claim 34 wherein the substrate is formed of paper.

36. Apparatus according to claim 34 wherein the substrate is formed of a plastic.

37. Apparatus according to claim 25 wherein the image is a toner image.

38. Apparatus according to claim 25 wherein the toner image is a image formed by a liquid toner process.

39. Apparatus according to claim 38 wherein the toner image on the surface comprises toner particles and carrier liquid.

40. Apparatus according to claim 39 wherein the toner particles solvate the carrier liquid at elevated temperatures above a salvation temperature and wherein the first temperature is above the solvation temperature.

41. Apparatus according to claim 40 wherein the second temperature is below the solvation temperature.

42. Apparatus according to claim 40 wherein the third temperature is below the solvation temperature.

* * * * *

UNITED STATES PATENT AND TRADEMARK OFFICE

CERTIFICATE OF CORRECTION

PATENT NO. : 6,562,539 B1
APPLICATION NO. : 09/914521
DATED : May 13, 2003
INVENTOR(S) : Ebud Chatow et al.

It is certified that error appears in the above-identified patent and that said Letters Patent is hereby corrected as shown below:

Col. 12, line 1;
Claim 40, line 3, change “salvation” to --solvation--

Signed and Sealed this

Thirty-first Day of July, 2007

JON W. DUDAS
*Director of the United States Patent and Trademark Office*

UNITED STATES PATENT AND TRADEMARK OFFICE

CERTIFICATE OF CORRECTION

PATENT NO. : 6,562,539 B1
APPLICATION NO. : 09/914521
DATED : May 13, 2003
INVENTOR(S) : Ehud Chatow et al.

It is certified that error appears in the above-identified patent and that said Letters Patent is hereby corrected as shown below:

Title Page; item (75); please correct the spelling of the first name of the inventor from:

INVENTOR(S) : Ebud Chatow et al to:

INVENTOR(S) : Ehud Chatow et al

Col. 12, line 1;
Claim 40, line 3, change “salvation” to --solvation--

Signed and Sealed this

Twentieth Day of May, 2008

JON W. DUDAS
*Director of the United States Patent and Trademark Office*